United States Patent [19]

Sekiguchi

[11] Patent Number: 4,929,189

[45] Date of Patent: May 29, 1990

[54] CONNECTOR WITH LOCKING MECHANISM

[75] Inventor: Shigemi Sekiguchi, Kiryu, Japan

[73] Assignee: Hosiden Electronics Co., Ltd., Osaka, Japan

[21] Appl. No.: 330,534

[22] Filed: Mar. 30, 1989

[30] Foreign Application Priority Data

Apr. 13, 1988 [JP] Japan ..... 63-50105[U]

[51] Int. Cl.[5] ..... H01R 13/627

[52] U.S. Cl. ..... 439/352; 439/357; 439/610

[58] Field of Search ..... 439/180, 347, 348, 350, 439/351, 352, 353, 354, 355, 356, 357, 358, 610; 285/315, 316, 319

[56] References Cited

U.S. PATENT DOCUMENTS 4,243,290 1/1981 Williams ..... 439/610

4,810,210 3/1989 Komatsu ..... 439/610

*Primary Examiner*—Neil Abrams

*Assistant Examiner*—Khiem Nguyen

*Attorney, Agent, or Firm*—Pollock, Vande Sande and Priddy

[57] ABSTRACT

In a connector with a locking mechanism an insulator body having contact pins is disposed in a cylindrical metal cover having a tongue formed integrally therewith by cutting a U-shaped groove in its forward portion. The tongue has in its front end portion a radially outward protrusion for locking use formed integrally therewith. An elastic piece is slidably disposed in contact with the underside of the tongue, the rear end portion of the elastic piece projecting out of the metal cover through a slot made therein and coupled as a unitary structure with a drive member mounted on the outside of the metal cover. The rear end portion of the metal cover is covered with a metal shell, and a coiled spring is interposed between the metal shell and the drive member, thereby biasing the elastic piece forwardly. A cable connected to the contact pins is led out through the metal shell, and a bush of a synthetic resin material is formed on the rear end portion of the shell and the adjoining portion of the cable. A cylindrical unlocking member is mounted on the outside the coiled spring, the shell and the forward portion of the bush. By pulling back the unlocking member, the elastic piece can be slid back relative to the tongue.

10 Claims, 1 Drawing Sheet

CONNECTOR WITH LOCKING MECHANISM

BACKGROUND OF THE INVENTION

The present invention relates to a small-sized, rod-shaped connector having a locking mechanism by which it is automatically locked to a mating connector when plugged thereinto.

Conventional rod-shaped small connectors of the so-called miniature DIN type have no locking mechanism, on account of which they readily disconnect upon occurrence of even a slight pull or vibration. Connectors with a locking mechanism heretofore proposed are relatively bulky and the locking mechanism is also relatively complex. Moreover, the prior art connectors with locking mechanism do not take sufficient measures to prevent leakage of electromagnetic noise to the outside and guard against external noise, as stated in Ezure U.S. Pat. No. 4,548,455 issued on Oct. 22, 1985.

SUMMARY OF THE INVENTION

It is therefore an object of the present invention to provide a small and electromagnetically shielded connector having a locking mechanism.

According to the present invention, a body of a synthetic resin material having contact pins built therein is received in a cylindrical metal cover. The metal cover has a tongue formed integrally therewith by cutting a U-shaped groove in its forward portion, and the tongue has an outward protrusion at its front end portion. An elastic piece of an elastic synthetic resin material is slidably disposed in contact with the underside of the tongue in the metal cover. The elastic piece carries at its rear end a drive member formed integrally therewith and held on the outside of the metal cover. The rear end portion of the metal cover is covered with a metal shell. A coiled spring is interposed between the shell and the drive member, by which the elastic piece is urged forwardly. A bush of a synthetic resin material is put on the shell, for protecting a cable which is led out of the shell. A cylindrical unlocking member is mounted on the connector assembly in engagement with the drive member so that the elastic piece can be pulled back.

DESCRIPTION OF THE PREFERRED EMBODIMENT

Figure 1:
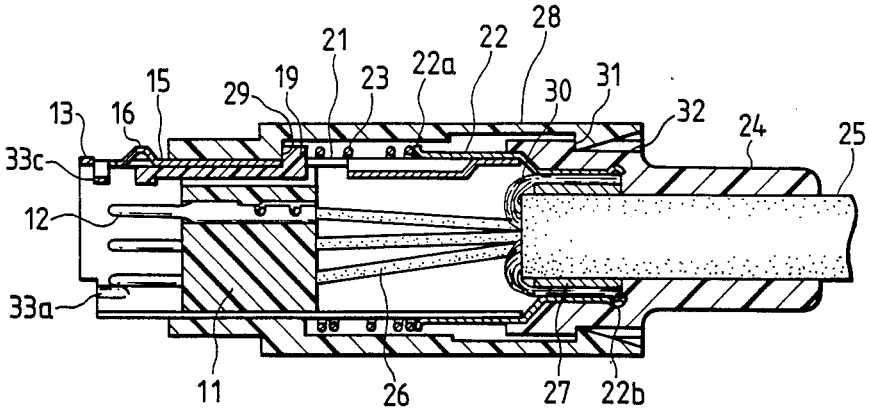
FIG. 1 is a sectional view illustrating an embodiment of the present invention.
Figure 2:
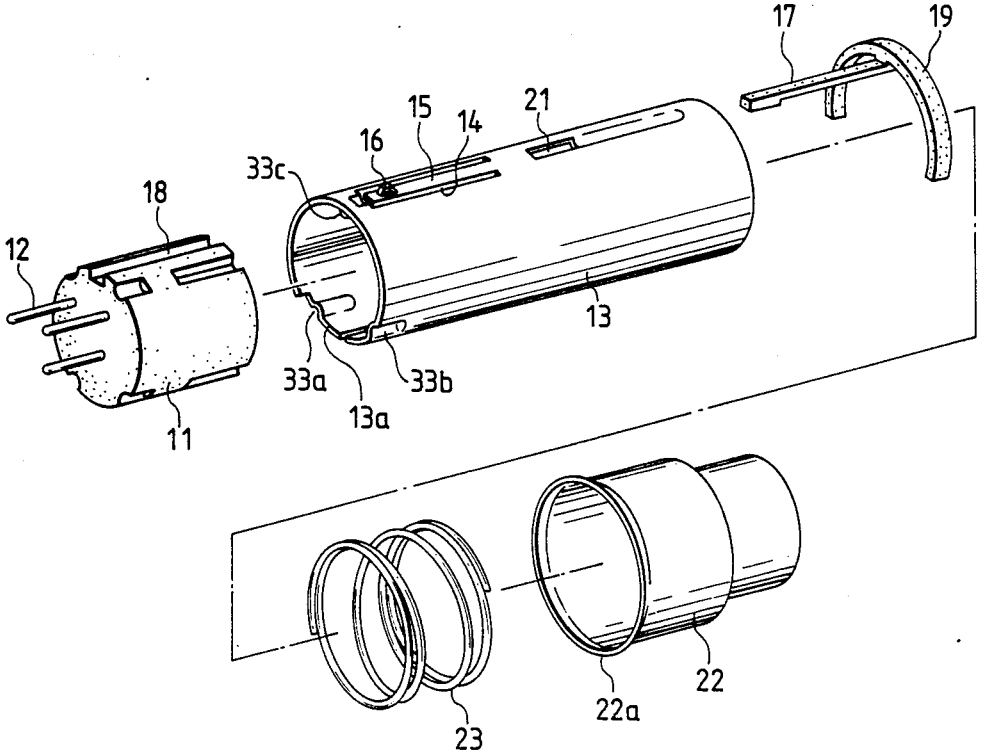
FIG. 2 is an exploded perspective view showing a part of the embodiment.

FIG. 1 illustrates an embodiment of the present invention and FIG. 2 is an exploded perspective view showing a part of the embodiment. A columnar body 11 of a synthetic resin material has a plurality of contact pins 12 built therein and projecting out from the front end face thereof. The body 11 is held in a cylindrical metal cover 13. The metal cover 13 has in its forward portion a U-shaped groove 14, forming a tongue 15 coupled at its rear end to the cover 13. The tongue 15 extends axially forwardly substantially in level with the wall of the metal cover 13 and has in its forward end an outward protrusion 16 for locking use.

An elastic piece 17 made of an elastic resin material is slidably received in a guide groove 18 made in the body 11 lengthwise thereof and is held in contact with the underside of the tongue 15. The elastic piece 17 carries at its rear end a semi-ringed drive member 19 formed integrally therewith and having an arc length longer than a half circle. The drive member 19 projects out on the outside of the metal cover 13 through a hole 21 made therein and rests astride the metal cover 13 along the outer peripheral surface thereof. The front ends of the elastic piece 17 and the tongue 15 lie substantially side by side.

The rear end portion of the metal cover 13 is fixedly received in a large-diametered front portion of a metal shell 22. The shell 22 has a flange **22*a* formed integrally therewith at its front end, and a coiled spring 23, which is interposed between the flange 22*a* and the drive member 19, is mounted around the metal cover 13, by which the elastic piece 17 is biased forwardly. Since the arc length of the drive member 19 is longer than a half circle, the drive member 19 can apply a pressure to the substantial part of the front coil of the spring 23 when moving rearward, thus lessening asymmetry in compression of the coiled spring and allowing stable and reliable locking operation for a long period. Lead wires 26 of a cable 25 are connected to the rear ends of the contact pins 12 corresponding thereto, respectively. A ferrule 27 is put on the inner end portion of the cable 25. Shielding wires 30 of the cable 25 are turned back onto the ferrule 27, and the rear end portion of the shell 22 is crimped around the shielding wires 30 to clamp the cable 25. The large-diametered front portion of the shell 22 except for the flange 22*a* is also crimped around the metal cover 13, whereby the shell 22 is fixedly clamped on the metal cover 13. The rear portion of the shell 22 is covered with a bush 24 of a synthetic resin material formed integrally therewith. A cable 25 is led out through the bush 24, and hence is protected by it. The rear end portion of the shell 22 has a ring-shaped protrusion 22*b* swollen along its circumferential marginal edge, by which the bush 24 is prevented from coming off the shell 22. The ring-shaped protrusion 22*b* can automatically be formed by leaving the rearmost end of the shell 22 uncrimped when clamping the cable 25**.

The metal cover 13 is covered with a cylindrical unlocking member 28 made of a synthetic resin material. An inner stepped portion 29 of the unlocking member 28 engages with the front of the drive member 19 and a claw 31 formed on the inside of the rear end portion of the unlocking member 28 engages with the front of a recess 32 of the bush 24 so that the unlocking member 28 is held in position. When pulling the unlocking member 28 backward, the elastic piece 17 is moved back against the biasing force of the coiled spring 23.

The metal cover 13 has protrusions **33*a* and 33*b* formed in the interior surface of its front end retracted portion 13*a* and extending lengthwise thereof, ad another protrusion 33*c* in front of the elastic piece 17 for engagement with corresponding positioning grooves of the mating connector. The protrusion 33*c* also acts as a guard for the elastic piece 17** against a twisting force during rotational positioning of the connector with respect to a mating connector.

With the structure described above, the connector of the present invention, when inserted into a mating connector, is positioned relative thereto by the engagement of the protrusions **33*a* to 33*c* with the positioning grooves of the mating connector. At this time, the tongue 15 and the elastic piece 17 are intended to be slid into one of the positioning grooves of the mating connector corresponding to the protrusion 33*c*, but the outward protrusion 16 of the tongue 15 is pressed radially inwardly of the metal cover 13 by a portion of the mating connector, causing radially inward displacement of the elastic piece 17. As a result, the radially inner face of the front end portion of the elastic piece 17 projects down beyond the protrusion 33c, causing abutment of the front end face of the elastic piece 17 against a front face of the mating connector. As the front portion of the metal cover 13 enters an annular groove of the mating connector, the elastic piece 17 is pushed back relative to the metal cover to compress the coiled spring via the drive member 19. Having been inserted sufficiently deep into the mating connector, the tongue 15 springs back upwardly bringing the protrusion 16 into engagement with a recess in the mating connector, and then the elastic piece 17 is pushed forward into the corresponding positioning groove of the mating connector by the coiled spring 22. Thus, the connector is locked to the mating connector, with the protrusion 16** held in engagement with the recess of the latter.

The connector can easily be unlocked by the following procedure. Pulling back the unlocking cylindrical member 28, the elastic piece 17 is also moved back at the same time, permitting the protrusion 16 to be pressed down inwardly. Then, by pulling back the connector relative to the mating connector, the protrusion 16 easily comes out of the recess of the latter, thus allowing the two connectors to be disengaged from each other. The basic operation principle of this locking mechanism is similar to that disclosed in the aforementioned U.S. Pat. No. 4,548,455.

As described above, according to the present invention, since one of the positioning grooves of the conventional non-locking-type connector can be utilized for the locking operation, the locking mechanism can be provided without the need of modifying electrical connections and changing the overall size of the connector. In other words, the connector with the locking mechanism according to the present invention can be formed small in size. Accordingly, the connector of the present invention can be used with the conventional non-locking-type connector.

Moreover, as will be appreciated from the above description, the connector of the present invention has its interior almost completely covered with metallic parts, and hence is not likely to leak out electromagnetic noise nor is it susceptible to the influence of external noise.

A cap of synthetic resin may also be used as a stopper for receiving the rear end of the coiled spring 23, but this will increase the number of parts used. By forming the flange 22a on the shell 22 as referred to above, however, the stopper for the coiled spring 23 can be obtained without necessitating any added parts. The flange 22a can easily be provided, because the shell 22 is produced by drawing a rolled material.

It will be apparent that many modifications and variations may be effected without departing from the scope of the novel concepts of the present invention.

What is claimed is:

1. A connector with a locking mechanism comprising:

an elongated body of synthetic resin having contact pins therein, said body having a guide groove formed in its outer peripheral surface and extending in the lengthwise direction of said body;

a cylindrical metal cover which receives said body therein, said cover having a U-shaped groove cut in a forward portion thereof to define a tongue that is substantially in level with a peripheral wall of said cylindrical metal cover, said tongue having a front end portion which includes a radially outward locking protrusion and having a rear end portion which is connected integrally with said cylindrical metal cover;

an elastic piece of an elastic synthetic resin material which carries at a rear end thereof a drive member formed integrally therewith, said elastic piece being inserted into said cylindrical metal cover through a slot formed therein and being guided in said guide groove of said body so that said elastic piece is held in contact with the underside of said tongue in slidable relation relative to said tongue, said drive member being held in the outside of said cylindrical metal cover;

a metal shell mounted on a rear end portion of said cylindrical metal cover;

a coiled spring mounted around said cylindrical metal cover and interposed between said drive member and said metal shell;

a bush of synthetic resin which is fixedly mounted on said metal shell for protecting a cable which is led out therefrom; and a cylindrical unlocking member which covers said bush, said metal shell and said cylindrical metal cover, said unlocking member being engaged with said drive member for selectively shifting said elastic piece in a rearward direction.

2. The connector of claim 1, wherein said metal shell has in its forward end a flange formed integrally therewith for receiving the rear end of the coiled spring.

3. The connector of claim 1, wherein said metal shell has in its rear end portion a ring-shaped protrusion formed integrally therewith for preventing said bush from disengagement.

4. The connector of claim 1, wherein a cable is passed through the bush, lead wires of the cable being connected to the contact pins respectively corresponding thereto.

5. The connector of claim 4 wherein the inner end portion of the cable is covered with a ferrule, shielding wires of the cable being folded back onto the ferrule, and the rear end portion of the metal shell being crimped onto the ferrule.

6. The connector of claim 1, 2, 3 or 4 wherein said drive member is a semi-ringed member extending along the outer peripheral surface of said metal cover.

7. The connector of claim 6, wherein said semi-ringed drive member has an arc length longer than a half circle.

8. The connector of claim 1, 2, 3 or 4, wherein said metal cover has a radially inward protrusion formed integrally therewith axially forward of the front tip of the elastic piece.

9. A connector with locking mechanism comprising:

a columnar body of synthetic resin having contact pins therein, said body having a guide groove formed in its outer peripheral surface to extend in the axial direction of said body;

a cylindrical metal cover which receives said body therein, said cover having a tongue defined substantially in level with a peripheral wall of said cover by a U-shaped groove cut in a forward portion of said cylindrical metal cover, said tongue having a front end portion that includes a radially outward locking protrusion and having a rear end that is connected integrally with said cylindrical metal cover;

an elastic piece of an elastic synthetic resin material which carries at a rear end thereof a drive member formed integrally therewith, said elastic piece being inserted into said cylindrical metal cover through a slot formed therein and being guided in said guide groove of said body so that said elastic piece is held in contact with the underside of said tongue and is slidable back and forth relative to said tongue, said drive member being located outside of said cylindrical metal cover;

a coiled spring mounted around said cylindrical metal cover axially behind said drive member for biasing said drive member in a forward direction; and a cylindrical unlocking member mounted around said coiled spring and said cylindrical metal cover in engagement with said drive member for shifting the position of said elastic piece in a rearward direction.

10. The connector of claim 9 wherein said drive member is semi-ringed in configuration and extends around a portion of the outer peripheral surface of said metal cover.

* * * * *